US008328708B2

(12) United States Patent
Piramoon et al.

(10) Patent No.: US 8,328,708 B2
(45) Date of Patent: Dec. 11, 2012

(54) FIBER-REINFORCED SWING BUCKET CENTRIFUGE ROTOR AND RELATED METHODS

(75) Inventors: Sina Piramoon, San Jose, CA (US); Alireza Piramoon, Santa Clara, CA (US)

(73) Assignee: Fiberlite Centrifuge, LLC, Santa Clara, CA (US)

( * ) Notice: Subject to any disclaimer, the term of this patent is extended or adjusted under 35 U.S.C. 154(b) by 615 days.

(21) Appl. No.: 12/631,999

(22) Filed: Dec. 7, 2009

(65) Prior Publication Data

US 2011/0136647 A1 Jun. 9, 2011

(51) Int. Cl.
*B04B 5/02* (2006.01)
*B65H 81/00* (2006.01)

(52) U.S. Cl. ..... 494/20; 156/185

(58) Field of Classification Search ..... 494/17–21, 494/31, 33, 43, 81; 74/572.11–572.12; 156/160–192, 195, 272.2; 242/433
See application file for complete search history.

(56) References Cited

U.S. PATENT DOCUMENTS

| | | | |
|---|---|---|---|
| 596,338 | A | 12/1897 | Salenius |
| 963,073 | A | 7/1910 | Salenius |
| 3,602,066 | A | 8/1971 | Wetherbee, Jr. |
| 3,797,737 | A | 3/1974 | Kadotani et al. |
| 3,913,828 | A | 10/1975 | Roy |
| 4,020,714 | A | 5/1977 | Rabenhorst |
| 4,023,437 | A | 5/1977 | Rabenhorst |
| 4,036,080 | A | 7/1977 | Friedericy et al. |
| 4,093,118 | A | 6/1978 | Sinn et al. |
| 4,123,949 | A | 11/1978 | Knight, Jr. et al. |
| 4,176,563 | A | 12/1979 | Younger |
| 4,183,259 | A | 1/1980 | Giovachini et al. |
| 4,207,778 | A | 6/1980 | Hatch |
| 4,266,442 | A | 5/1981 | Zorzi |
| 4,285,251 | A | 8/1981 | Swartout |
| 4,341,001 | A | 7/1982 | Swartout |
| 4,359,912 | A | 11/1982 | Small |
| 4,391,597 | A | 7/1983 | Piramoon et al. |
| 4,435,168 | A | 3/1984 | Kennedy |
| 4,443,727 | A | 4/1984 | Annen et al. |
| 4,449,966 | A | 5/1984 | Piramoon |

(Continued)

FOREIGN PATENT DOCUMENTS

DE 1 782 602 B 3/1972

(Continued)

OTHER PUBLICATIONS

Espacenet, Abstract, English Machine Translation of JP56111063A, published Sep. 2, 1981, retrieved from http://worldwide.espacenet.com on Aug. 23, 2012 (2 pages).

(Continued)

*Primary Examiner* — Charles E Cooley
(74) *Attorney, Agent, or Firm* — Wood, Herron & Evans, LLP

(57) ABSTRACT

A centrifuge rotor is provided having a rotor core that defines a rotational axis of the rotor. A plurality of bucket supports is arranged about the axis of rotation. The rotor includes first and second straps that respectively wrap around two diametrically-opposed ones of the bucket supports for restricting outward movement of the two bucket supports relative to the rotor core. The first and second straps intersect one another at a location through the axis of rotation of the rotor.

15 Claims, 4 Drawing Sheets

U.S. PATENT DOCUMENTS

| | | | | |
|---|---|---|---|---|
| 4,468,269 | A | 8/1984 | Carey | |
| 4,481,840 | A | 11/1984 | Friedericy et al. | |
| 4,501,565 | A | 2/1985 | Piramoon | |
| 4,502,349 | A | 3/1985 | Abiven et al. | |
| 4,548,596 | A | 10/1985 | Sutton, III et al. | |
| 4,585,433 | A | 4/1986 | Cole | |
| 4,585,434 | A | 4/1986 | Cole | |
| 4,586,918 | A | 5/1986 | Cole | |
| 4,589,864 | A | 5/1986 | Cole | |
| 4,624,655 | A | 11/1986 | Cole | |
| 4,659,325 | A | 4/1987 | Cole et al. | |
| 4,670,004 | A | 6/1987 | Sharples et al. | |
| 4,675,001 | A | 6/1987 | Johanson | |
| 4,701,157 | A * | 10/1987 | Potter | 494/16 |
| 4,738,656 | A | 4/1988 | Piramoon et al. | |
| 4,781,669 | A | 11/1988 | Piramoon | |
| 4,790,808 | A | 12/1988 | Piramoon | |
| 4,817,453 | A | 4/1989 | Breslich, Jr. et al. | |
| 4,824,429 | A | 4/1989 | Keunen et al. | |
| 4,860,610 | A | 8/1989 | Popper et al. | |
| 4,886,486 | A | 12/1989 | Grimm et al. | |
| 4,991,462 | A | 2/1991 | Breslich, Jr. et al. | |
| 5,057,071 | A | 10/1991 | Piramoon | |
| 5,206,988 | A | 5/1993 | Piramoon | |
| 5,362,301 | A | 11/1994 | Malekmadani et al. | |
| 5,376,199 | A | 12/1994 | Humphrey et al. | |
| 5,382,219 | A | 1/1995 | Malekmadani | |
| 5,411,465 | A | 5/1995 | Glen et al. | |
| 5,505,684 | A | 4/1996 | Piramoon | |
| 5,527,257 | A | 6/1996 | Piramoon | |
| 5,533,644 | A | 7/1996 | Glen et al. | |
| 5,540,126 | A | 7/1996 | Piramoon | |
| 5,545,118 | A | 8/1996 | Romanauskas | |
| 5,562,582 | A | 10/1996 | Malekmadani | |
| 5,562,584 | A | 10/1996 | Romanauskas | |
| 5,601,522 | A | 2/1997 | Piramoon | |
| 5,643,168 | A | 7/1997 | Piramoon et al. | |
| 5,683,341 | A | 11/1997 | Giebeler | |
| 5,759,592 | A | 6/1998 | Piramoon et al. | |
| 5,776,400 | A | 7/1998 | Piramoon et al. | |
| 5,833,908 | A | 11/1998 | Piramoon et al. | |
| 5,846,364 | A | 12/1998 | Policelli | |
| 5,876,322 | A | 3/1999 | Piramoon | |
| 5,972,264 | A | 10/1999 | Malekmadani et al. | |
| 6,056,910 | A | 5/2000 | Fritsch et al. | |
| 6,296,798 | B1 | 10/2001 | Piramoon | |
| 6,482,342 | B1 | 11/2002 | Malekmadani et al. | |
| 6,916,282 | B2 | 7/2005 | Aizawa | |
| 7,150,708 | B2 | 12/2006 | Lurz | |
| 8,147,392 | B2 | 4/2012 | Piramoon et al. | |
| 8,147,393 | B2 | 4/2012 | Piramoon et al. | |
| 8,211,002 | B2 | 7/2012 | Piramoon et al. | |
| 8,273,202 | B2 * | 9/2012 | Piramoon et al. | 156/172 |
| 2010/0018344 | A1 | 1/2010 | Spears et al. | |
| 2010/0184578 | A1 | 7/2010 | Piramoon et al. | |
| 2010/0216622 | A1 | 8/2010 | Piramoon et al. | |
| 2010/0273626 | A1 | 10/2010 | Piramoon | |
| 2010/0273629 | A1 | 10/2010 | Piramoon et al. | |
| 2011/0023636 | A1 | 2/2011 | Atkins et al. | |
| 2011/0111942 | A1 | 5/2011 | Piramoon | |
| 2011/0136647 | A1 | 6/2011 | Piramoon et al. | |
| 2012/0180941 | A1 | 7/2012 | Piramoon et al. | |
| 2012/0186731 | A1 | 7/2012 | Piramoon et al. | |

FOREIGN PATENT DOCUMENTS

| | | | |
|---|---|---|---|
| DE | 27 49 785 | A1 | 5/1979 |
| EP | 0 176 970 | A2 | 4/1986 |
| EP | 0225610 | A2 | 6/1987 |
| EP | 0 326 680 | A2 | 8/1989 |
| JP | 56111063 | A | 9/1981 |
| JP | 58219958 | A | 12/1983 |
| JP | 60090057 | A | 5/1985 |
| JP | 60118259 | A | 6/1985 |
| JP | 63319074 | A | 12/1988 |
| JP | 1135550 | A | 5/1989 |
| JP | 6071801 | A | 3/1994 |
| JP | 2010162538 | A | 7/2010 |
| JP | 2010253467 | A | 11/2010 |
| WO | 9102302 | A1 | 2/1991 |
| WO | 9325315 | A1 | 12/1993 |
| WO | 9415714 | A1 | 7/1994 |
| WO | 9635156 | A1 | 11/1996 |
| WO | 9855237 | A1 | 12/1998 |

OTHER PUBLICATIONS

Espacenet, Abstract, English Machine Translation of JP58219958A, published Dec. 21, 1983, retrieved from http://worldwide.espacenet.com on Aug. 23, 2012 (2 pages).

Espacenet, Abstract, English Machine Translation of JP60090057A, published May 21, 1985, retrieved from http://worldwide.espacenet.com on Aug. 23, 2012 (2 pages).

Espacenet, Abstract, English Machine Translation of JP60118259A, published Jun. 25, 1985, retrieved from http://worldwide.espacenet.com on Aug. 23, 2012 (2 pages).

Espacenet, Abstract, English Machine Translation of JP61101262A, published May 20, 1986, retrieved from http://worldwide.espacenet.com on Aug. 23, 2012 (2 pages).

Espacenet, Abstract, English Machine Translation of JP1135550A, published May 29, 1989, retrieved from http://worldwide.espacenet.com on Aug. 23, 2012 (2 pages).

Espacenet, Abstract, English Machine Translation of JP6071801A, published Mar. 15, 1994, retrieved from http://worldwide.espacenet.com on Aug. 23, 2012 (2 pages).

Espacenet, English Machine Translation of JP2010162538A, published Jul. 29, 2010, retrieved from http://worldwide.espacenet.com on Aug. 23, 2012 (10 pages).

Espacenet, English Machine Translation of JP2010253467A, published Nov. 11, 2010, retrieved from http://worldwide.espacenet.com on Aug. 23, 2012 (13 pages).

United Kingdom Intellectual Property Office, Search and Examination Report in British Patent Application No. GB1000530.4 dated Apr. 30, 2010 (5 pages).

European Patent Office, International Search Report and Written Opinion of the International Searching Authority, International Application No. PCT/US2010/059231, mailed Mar. 8, 2011 (9 pages).

* cited by examiner

FIBER-REINFORCED SWING BUCKET CENTRIFUGE ROTOR AND RELATED METHODS

TECHNICAL FIELD

This invention relates generally to centrifuge rotors and, more particularly, to high-speed centrifuge rotors to be used with swing buckets.

BACKGROUND

Centrifuge rotors are typically used in laboratory centrifuges to hold samples during centrifugation. While centrifuge rotors may vary significantly in construction and in size, one common rotor structure is a swing bucket rotor having a solid rotor body defining an outer rim or wall of the rotor, and a plurality of wells or bays in a number such as two, four, or six for example, distributed radially within the rotor body and arranged symmetrically about an axis of rotation. The presence of the outer rim or wall provides structural rigidity to the rotor, especially in view of the high dynamic forces experienced during centrifugation. Buckets are placed in the wells, and are configured to hold sample tubes or similar laboratory-type containers, each containing a particular fluid material. During high-speed rotation, the buckets are permitted to swing within the wells, with the attained generally horizontal orientation of the buckets facilitating radially outward movement of the material held in the tubes.

One conventional type of swing bucket centrifuge rotor includes a generally metallic rotor configured to support an even number of swing buckets, such as four, six, or eight, for example, on diametrically opposite sides of the rotational axis of the rotor. In rotors of this type, and because of the very high rotational speeds during centrifugation, the rotor bodies must be able to withstand the dynamic stresses and forces generated by the rapid rotation of the swing buckets about the central rotational axis. These dynamic stresses and forces may lead to failure of the metallic rotor, such as fatigue failure. Additionally or alternatively, conventional metallic rotors of this type are subject to corrosion and stress fatigue. Finally, the generally solid construction of conventional rotors results in rotors that are relatively heavy and which may be expensive to manufacture. A need therefore exists for improved swing bucket rotors that overcome these and other drawbacks of conventional centrifuge rotors.

SUMMARY

The present invention overcomes the foregoing and other shortcomings and drawbacks of centrifuge rotors heretofore known for use for centrifugation. While the invention will be discussed in connection with certain embodiments, it will be understood that the invention is not limited to these embodiments. On the contrary, the invention includes all alternatives, modifications, and equivalents as may be included within the spirit and scope of the invention.

In one embodiment, a centrifuge rotor is provided having a rotor core that defines a rotational axis of the rotor. A plurality of bucket supports is arranged about the axis of rotation. The rotor includes first and second straps. The first strap extends around a first pair of diametrically-opposed ones of the bucket supports for restricting outward movement of the first pair of bucket supports relative to the rotor core. The second strap extends around a second pair of diametrically-opposed ones of the bucket supports for restricting outward movement of the second pair of bucket supports relative to the rotor core.

The first and second straps intersect one another at a location through the axis of rotation of the rotor. The rotor may include a plurality of elongate arms extending from a central portion of the rotor core, with each of the bucket supports being located at a longitudinal end of one of the elongate arms. The rotor may be such that each bucket support has first and second trunnions, with each of the trunnions being respectively configured to support a bucket, and with each of the bucket supports defining an outer perimeter of the rotor.

The first and second straps may be made of a high tensile-strength fiber material. For example, the first and second straps may be made of carbon fiber, an aramid fiber, a polyolefin fiber, or the like. Moreover, the first and second straps may be a composite material in which the fibers are encapsulated in a resin, such as a thermoplastic resin or a thermosetting resin. A composite of carbon fibers in a thermosetting material is only an example. The first strap may define a first loop and the second strap may define a second loop, with the second loop being larger than the first loop. In a specific embodiment, the first strap is located completely within the second loop at the location of intersection of the first and second straps with one another. Alternatively or additionally, the second strap may have an upper surface that extends in a curved plane intersecting the second pair of diametrically-opposed ones of the bucket supports. At least one of the first or second pairs of diametrically-opposed bucket supports may include respective grooves for respectively receiving the first or second strap therein.

In a specific embodiment, each of the bucket supports includes first and second segments that are arranged in a suitably-chosen shape, such as a generally V-shape, a generally T-shape, or a generally Y-shape, for example, with the first and second segments respectively including the first and second trunnions. Each of the first and second trunnions may be oriented at an acute angle relative to an adjacent one of the first or second straps. The first and second straps, in one embodiment supporting four buckets, are oriented substantially orthogonal to one another. The rotor may include a rotor hub that is coupled to the rotor core and which is configured for engagement by a centrifuge spindle. The rotor hub is coupled to the rotor core at locations circumferentially spaced from the first and second straps.

In another embodiment, a centrifuge rotor is provided. The rotor has a rotor core that defines an axis of rotation of the rotor, and a plurality of bucket supports each arranged about the axis of rotation. Each bucket support has first and second trunnions, with each trunnion respectively configured to support a bucket. The rotor includes first and second straps oriented generally orthogonal to one another. The first strap extends around a first pair of diametrically-opposed ones of the bucket supports for restricting outward movement of the first pair of bucket supports relative to the axis of rotation. The second strap extends around a second pair of diametrically-opposed ones of the bucket supports for restricting outward movement of the second pair of bucket supports relative to the rotor core. The first and second straps intersect the axis of rotation.

In yet another embodiment, a method is provided for making a centrifuge rotor. The method includes arranging a plurality of bucket supports around a rotor core, with the rotor core including an axis of rotation. The method includes coupling a first strap to a first pair of diametrically-opposed ones of the bucket supports to restrict outward movement of the first pair of diametrically-opposed ones of the bucket supports relative to the rotor core. The first strap intersects the axis of rotation of the rotor. The method includes coupling a second strap to a second pair of diametrically-opposed ones of the bucket supports, and arranging the first and second straps such that they intersect one another at the location of intersection of the first strap and the axis of rotation.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
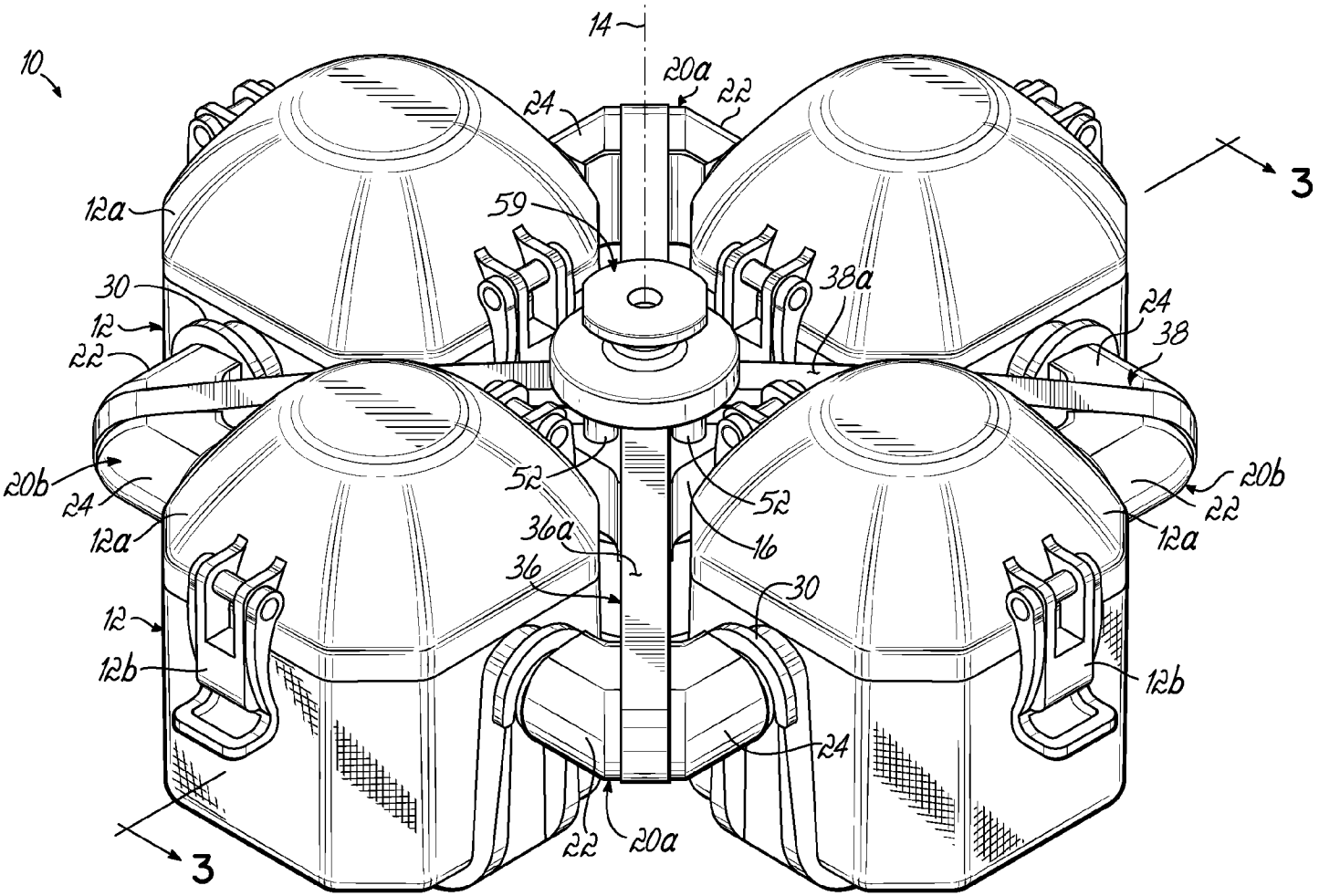
FIG. 1 is a perspective view of a centrifuge rotor in accordance with one embodiment of the present invention.

FIGS. 1-4 illustrate an exemplary centrifuge rotor 10 in accordance with one embodiment of the present invention. The rotor 10 supports a plurality of swing buckets 12, each configured to hold sample tubes and/or similar laboratory-type containers 13 for centrifugal rotation thereof about a central axis of rotation 14 defined by a rotor core 16 of the rotor 10. Each of the buckets 12 includes a selectively closable lid 12*a* and a pair of latches 12*b* configured to lock the lid 12*a* in place during centrifugation. An exemplary bucket 12 suitable for use with rotor 10 is disclosed in U.S. patent application Ser. No. 12/429,569 entitled SWING BUCKET FOR USE WITH A CENTRIFUGE ROTOR, commonly assigned to the assignee of the present application, and the disclosure of which is hereby expressly incorporated herein by reference in its entirety.

The rotor 10 includes a plurality of bucket supports 20*a*, 20*b* that are arranged for rotation about the axis 14. While the figures illustrate the exemplary bucket supports 20*a*, 20*b* being generally V-shaped, it is contemplated that they may alternatively be shaped differently, such as being generally T-shaped or generally Y-shaped, for example, or have any other shapes. The particular arrangement of the bucket supports 20*a*, 20*b* is such that each of the bucket supports 20*a*, 20*b* supports two of the buckets 12. More specifically, each bucket support 20*a*, 20*b* includes a pair of segments 22, 24, each having at a longitudinal end thereof a trunnion or pin 22*a*, 24*a* (FIG. 4), that is configured to support one of the buckets 12. To this end, each of the trunnions 22*a*, 24*a* engages a bushing 30 extending from a side wall of a bucket 12 to thereby support the bucket 12 in the illustrated generally vertical orientation of the bucket 12, as well as in the generally horizontal orientation (not shown) of the bucket 12 during centrifugation.

Figure 2:
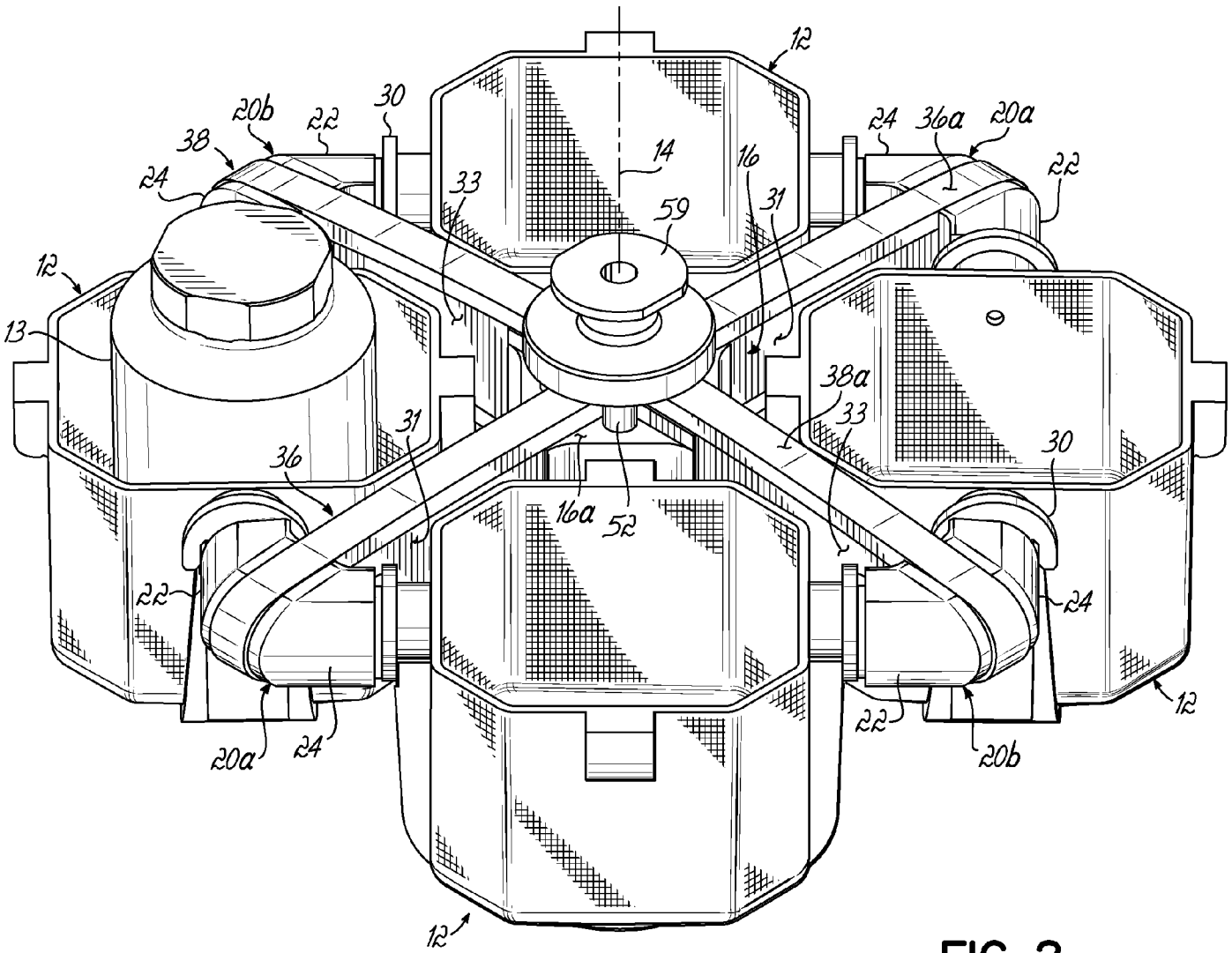
FIG. 2 is another perspective view of the rotor of FIG. 1 supporting a plurality of open buckets.

The bucket supports 20*a*, 20*b* define an outer perimeter of the rotor 10, as illustrated in FIGS. 1-2. In this regard, the rotor 10, unlike conventional swing bucket centrifuge rotors, does not have an outer wall or rim or a solid body defining such outer wall or rim. Notably, the absence of such outer wall or rim and the absence of a solid body construction (e.g., a metallic body having depressions or bores defining bucket-supporting bays or wells of the rotor) make the rotor 10 relatively light in weight and relatively easy to manufacture. The present disclosure contemplates that, alternatively, rotor 10 may have an optional circumferentially extending outer shell or shield (not shown), for example, to reduce aerodynamic drag and windage noise, which may be desirable, for example, to facilitate greater temperature control and reduce the required power to drive the rotor 10.

Figure 4:
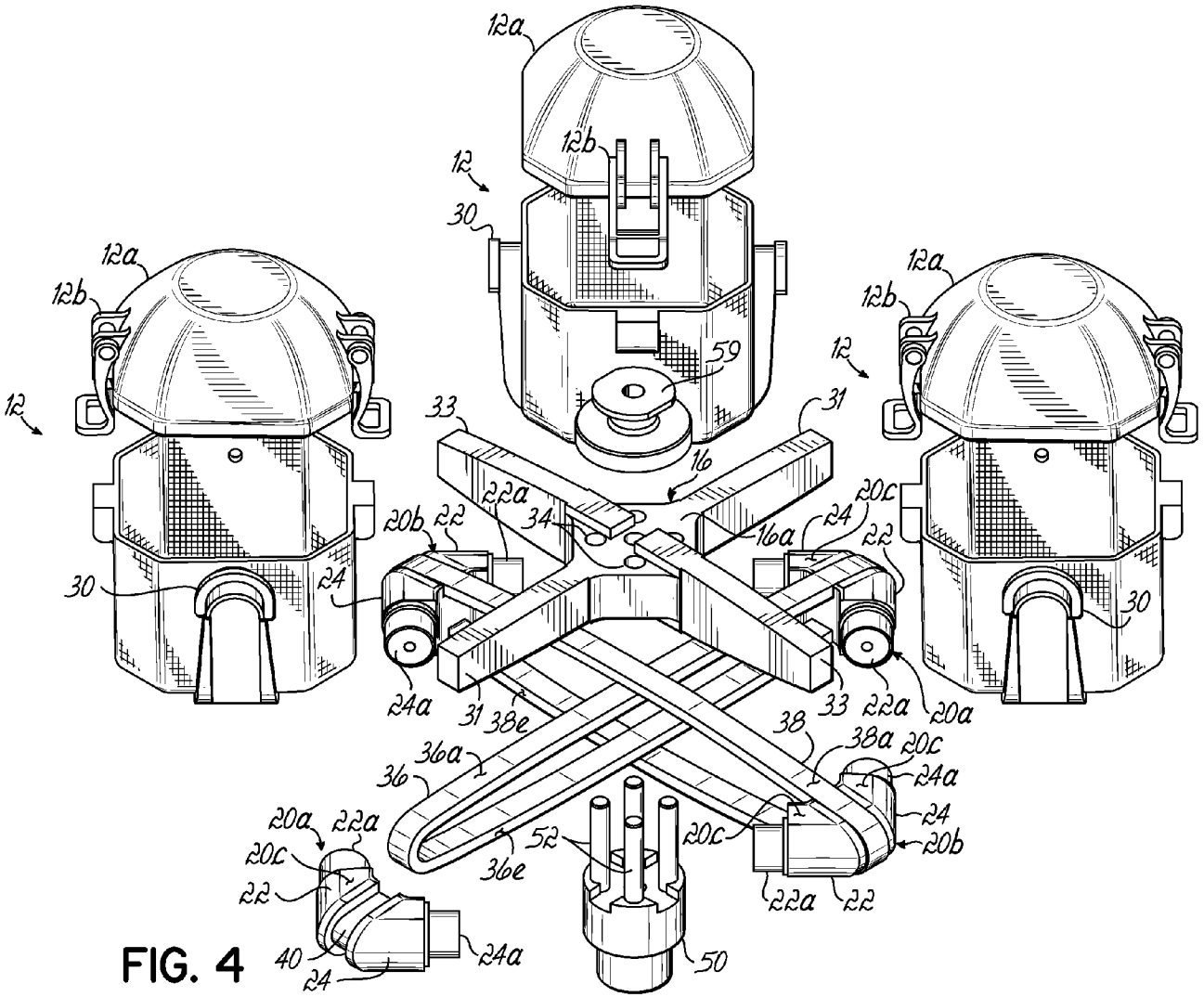
FIG. 4 is a partially disassembled view of the rotor of FIGS. 1-3.

With particular reference to FIG. 4, the rotor core 16 includes a first pair of elongate members 31 extending from a central portion 16*a* of the rotor core 16 and spanning between a first pair of diametrically opposed bucket supports 20*a*, and a second pair of elongate members 33 extending from the central portion 16*a* and spanning between a second pair of diametrically opposed bucket supports 20*b*. Each of the bucket supports 20*a*, 20*b*, accordingly, is located at the longitudinal end of each of the elongate members 31, 33. In another aspect, the central portion 16*a* of the rotor core 16 includes a plurality of holes 34 that, as explained in further detail below, facilitate coupling of the rotor 10 with a centrifuge spindle (not shown) for high-speed rotation of rotor 10.

With continued reference to FIGS. 1-4, even though the rotor 10 is of generally light construction, it maintains the required structural integrity during centrifugation. Such structural integrity is facilitated, in this exemplary embodiment, by a pair of reinforcing straps oriented substantially orthogonal to one another, and which restrict outward movement of the bucket supports 20*a*, 20*b* relative to the rotor core 16 and, particularly, relative to the central portion 16*a* of rotor core 16. More specifically, the rotor 10 includes a first strap 36 and a second strap 38. The first strap 36 extends around and is operatively coupled to each of the first pair of diametrically-opposed bucket supports 20*a*, while the second strap 38 extends around and is operatively coupled to each of the second pair of diametrically-opposed bucket supports 20*b*. The orientation of the straps 36, 38 is such that each of the segments 22, 24 and, particularly, each of the trunnions 22*b*, 24*a* of each bucket support 20*a*, 20*b*, extends in a direction defining an acute angle relative to the respective strap 36, 38 to which the respective bucket support 20*a*, 20*b* is coupled.

Those of ordinary skill in the art will readily appreciate that the acute angle illustrated in the figures is merely exemplary rather than limiting, insofar as other acute angles are contemplated. More specifically, the acute angle in this embodiment is about 45 degrees, by virtue of the specific arrangement of the four bucket supports 20*a*, 20*b* and the four buckets 12 supported by the bucket supports 20*a*, 20*b*. The present disclosure contemplates other embodiments having buckets 12 (and buckets supports 20*a*, 20*b*) in other numbers, such as two, six or eight, for example. In alternative embodiments having six or eight buckets 12, the respective acute angles defined by the orientation between the trunnions 22*a*, 24*a* and an adjacent strap 36, 38 are larger than about 45 degrees. Similarly, in embodiments having two buckets 12, the acute angle is smaller than about 45 degrees. Likewise, the number of straps in such alternative embodiments may be different from the exemplary two straps 36, 38 of the embodiment illustrated in the figures and still fall within the scope of the present disclosure.

Each of the straps 36, 38 is made of a light, yet strong material, such as fibrous material, a non-fibrous material, a composite material, or others, for example. In the embodiment shown in the figures, the straps 36, 38 are made of high-strength carbon fiber in a thermosetting resin, although this is merely exemplary rather than intended to be limiting. Suitable alternatives include other coated or uncoated high tensile-strength fibers. For example, and without limitation, such alternatives may include a carbon fiber in a thermoplastic resin, or an uncoated carbon fiber. In this regard, the straps 36, 38 may be formed, for example, by winding thermoplastic or thermosetting resin-coated filaments or strands of carbon fiber around the respective pairs of diametrically opposed bucket supports 20*a*, 20*b* and then applying pressure and heat to mold the strands into a unitary structure. Especially when the fiber is coated with a thermoplastic resin or a thermosetting resin, the resin may be allowed to cure for a predetermined length of time, so as to make it integral with other portions of the rotor 10. Each of the straps 36, 38 is wrapped around respective pairs of the bucket supports 20*a*, 20*b*, as illustrated in the figures, to thereby resist outward movement of the bucket supports 20*a*, 20*b* away from rotor core 16 during high-speed rotation. Each of the straps 36, 38 is respectively positioned over and supported by the elongate members 31, 33 of the rotor core 16.

Moreover, each of the bucket supports 20*a*, 20*b* includes a groove 40 (FIG. 4) that is suitably shaped and sized to receive a portion of one of the straps 36, 38 therein, to thereby secure the respective strap 36, 38 against movement relative to the respective bucket support 20*a*, 20*b* and relative to the elongate members 31, 33 during use. The grooves 40 also provide a path to guide the straps 36, 38 during manufacturing of the rotor 10.

The first and second straps 36, 38 are arranged in the rotor 10 so as to respectively define first and second loops, with the first loop being smaller than the second loop. More specifically, the first strap 36 defines a first loop that is smaller, in the vertical direction of the figures, than the second loop corresponding to the second strap 38. In this regard, the shape and dimensions of the first loop are also determined by the shape and dimensions of the first elongate member 31, while the shape and dimensions of the second loop are determined by the shape and dimensions of the second elongate member 33 of rotor core 16. This dimensional relationship of the straps 36, 38 facilitates their placement at the central portion 16*a* of rotor core 16. In this regard, the straps 36, 38 intersect one another at the location of central portion 16*a* that is also intersected by the axis of rotation 14. At the location of intersection of the straps 36, 38, the second strap 38 surrounds the first strap 36 such that the first strap 36 is completely within the second loop defined by the second strap 38.

Those of ordinary skill in the art will readily appreciate that the precise arrangement of the straps 36, 38 at the central portion 16*a* of rotor core 16 is merely exemplary rather than limiting. In this regard, it is contemplated that the straps 36, 38 may be formed from different sizes of tow or unidirectional tape, made for example and without limitation, of carbon fiber, Kevlar, or glass, such that the respective strands of the first and second straps 36, 38 are intertwined (i.e., interlaced) with one another. Such alternative arrangement would thus result in first and second loops that are not necessarily different in size relative to one another. While this embodiment specifically describes a rotor 10 having straps 36, 38 made of carbon fiber, it is contemplated that, alternatively, the straps 36, 38 may be made of other fibrous or non-fibrous high tensile-strength materials, so long as they provide the required structural integrity to the rotor 10.

Each of the straps 36, 38 includes a respective upper surface 36*a*, 38*a*. The upper surface 38*a* of the second strap 38 lies generally in a slightly curved plane in the span between the two bucket supports 20*b* to which the second strap 38 is coupled. The upper surface 36*a* of the first strap 36 also lies in a slightly curved plane in the span between the two bucket supports 20*a* to which the first strap 36 is coupled, but to a lesser extent than the upper surface 38*a* of strap 38. Moreover, in the illustrated embodiment, the second strap 38 is embedded within each of a pair of the grooves 40 of bucket supports 20*b* such that the plane in which the upper surface 38*a* lies also intersects the bucket supports 20*b*, specifically an upper surface 20*c* thereof. The second strap 38 in this embodiment is slightly raised in the portion of strap 38 proximate the central portion 16*a* of rotor core 16, to thereby accommodate the first strap 36 at the central portion 16*a*. These dimensional relationships define a rotor 10 that is simple to manufacture and is less bulky than conventional rotors. The slight raise of the second strap 38 is facilitated by a correspondingly greater height of the elongate member 33 relative to other portions thereof proximate the central portion 16*a*.

Figure 3:
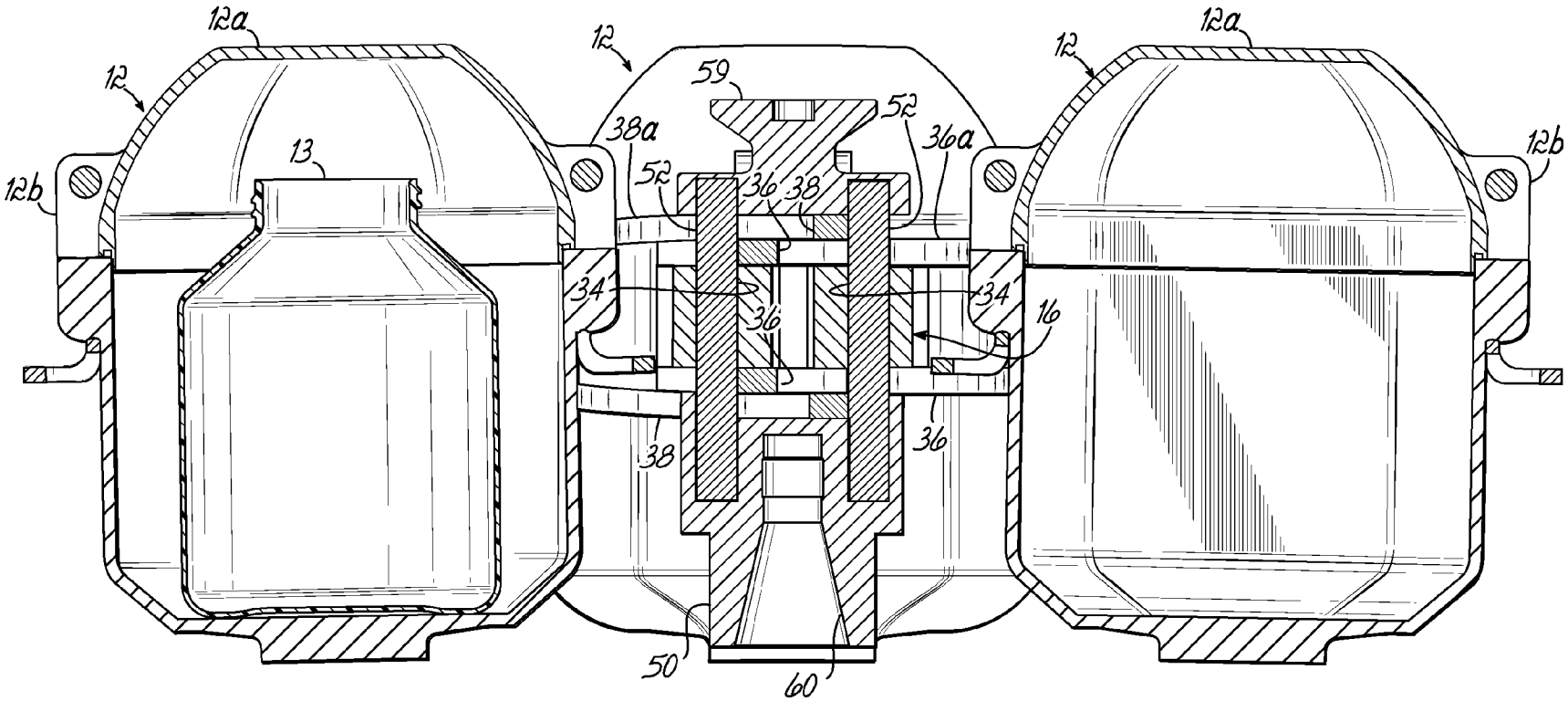
FIG. 3 is a cross-sectional view taken generally along line 3-3 of FIG. 1.

With particular reference to FIGS. 3-4, the rotor 10 includes a rotor hub 50 that facilitates engagement of rotor 10 by a spindle (not shown) for centrifugal rotation of the rotor 10. The rotor hub 50 is coupled to the central portion 16*a* of rotor core 16 so as not to interfere with the portions of the straps 36, 38 therein. More specifically, the rotor hub 50 is coupled to the central portion 16*a* through two or more drive pins 52 (there are four such drive pins 52 in this embodiment) extending between adjacent portions of the straps 36, 38 and therefore spaced circumferentially from each of the straps 36, 38. More specifically, the drive pins 52 extend vertically and are spaced circumferentially from one another between adjacent straps 36, 38 and are received through the holes 34 in central portion 16*a* of rotor core 16. The drive pins 52 are also supported within corresponding bores at an underside of a coupler 59 that secures the rotor 10 to the driving centrifuge spindle (not shown). In one aspect of the illustrated embodiment, the outer surfaces of the drive pins 52 are tangent to and in contact with respective side edges 36*e*, 38*e* of the straps 36, 38.

In use, and with particular reference to FIG. 3, the rotor 10 is operated by mounting the rotor hub 50 over a suitably chosen centrifuge spindle (not shown). More specifically, the spindle is received within a hub aperture 60 at the bottom of rotor hub 50. When the spindle is actuated, rotation of the spindle causes the drive pins 52 to transfer the driving torque to the rotor core 16, which in turn rotates the rotor 10, including the buckets 12.

While various aspects in accordance with the principles of the invention have been illustrated by the description of various embodiments, and while the embodiments have been described in considerable detail, they are not intended to restrict or in any way limit the scope of the invention to such detail. The various features shown and described herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A centrifuge rotor comprising:

a rotor core having a plurality of elongate arms extending from a central portion of said rotor core and defining an axis of rotation of the rotor;

a plurality of bucket supports operatively coupled to said rotor core and arranged about said axis of rotation, each bucket support being located at a longitudinal end of one of said elongate arms;

a first strap extending around a first pair of diametrically-opposed ones of said bucket supports for restricting outward movement of said first pair of bucket supports relative to said rotor core; and a second strap extending around a second pair of diametrically-opposed ones of said bucket supports for restricting outward movement of said second pair of bucket supports relative to said rotor core, said first and second straps intersecting one another at a location through said axis of rotation.

2. The rotor of claim 1, wherein said first and second straps are made of carbon fiber.

3. The rotor of claim 2, wherein said first and second straps are made of a carbon fiber coated with a thermoplastic resin or a thermosetting resin.

4. The rotor of claim 1, wherein each bucket support has first and second trunnions and each trunnion is respectively configured to support a bucket, each bucket support defining an outer perimeter of the rotor.

5. The rotor of claim 1, wherein each of said bucket supports includes first and second segments arranged in a generally V-shape, said first and second segments respectively including first and second trunnions, each configured to support a bucket.

6. The rotor of claim 1, wherein each bucket support has first and second trunnions and each trunnion is respectively configured to support a bucket, each of said first and second trunnions being oriented at an acute angle relative to an adjacent one of said first or second straps.

7. The rotor of claim 6, wherein each of said first pair of bucket supports has an upper surface, said first strap having an upper surface extending in a curved plane intersecting the upper surface of each of said first pair of bucket supports.

8. The rotor of claim 1, wherein said first strap defines a first loop and said second strap defines a second loop, said second loop being larger than said first loop.

9. The rotor of claim 8, wherein said first strap is located completely within said second loop at said location of intersection of said first and second straps with one another.

10. The rotor of claim 1, wherein at least one of said first or second pairs of bucket supports includes respective grooves for respectively receiving said first or second straps therein.

11. The rotor of claim 1, wherein said first and second straps are oriented substantially orthogonal to one another.

12. The rotor of claim 1, further comprising:

a rotor hub coupled to said rotor core and configured for engagement by a centrifuge spindle, said rotor hub being coupled to said rotor core at locations circumferentially spaced from said first and second straps.

13. The rotor of claim 12, wherein coupling between said rotor hub and said rotor core includes a plurality of drive pins extending from said rotor core and having respective outer surfaces, said outer surface of at least one of said drive pins contacting at least one of said first or second straps when said rotor hub and said rotor core are coupled to one another.

14. A method for making a centrifuge rotor including a rotor core having a plurality of elongate arms extending from a central portion of the rotor core and defining an axis of rotation of the rotor and a plurality of bucket supports operatively coupled to the rotor core and arranged about the axis of rotation, comprising:

locating each bucket support at a longitudinal end of one of said elongate arms;

coupling a first strap to a first pair of diametrically-opposed ones of the bucket supports to restrict outward movement of the first pair of diametrically-opposed ones of the bucket supports relative to the rotor core, the first strap intersecting the axis of rotation;

coupling a second strap to a second pair of diametrically-opposed ones of the bucket supports; and arranging the first and second straps such that they intersect one another at the location of intersection of the first strap and the axis of rotation.

15. The method of claim 14, wherein coupling of the first and second straps respectively to the first and second pairs of diametrically-opposed ones of the bucket supports includes wrapping each of the first and second straps respectively around the first or second pair of diametrically-opposed ones of the bucket supports.

* * * * *